US008186681B1

(12) United States Patent
Feola

(10) Patent No.: US 8,186,681 B1
(45) Date of Patent: May 29, 2012

(54) METHOD OF USING DECKS OF PLAYING CARDS

(75) Inventor: John Feola, North Reading, MA (US)

(73) Assignee: New Vision Gaming & Development, Inc., North Reading, MA (US)

( * ) Notice: Subject to any disclaimer, the term of this patent is extended or adjusted under 35 U.S.C. 154(b) by 0 days.

(21) Appl. No.: 13/084,920

(22) Filed: Apr. 12, 2011

Related U.S. Application Data

(60) Provisional application No. 61/323,299, filed on Apr. 12, 2010.

(51) Int. Cl.
*A63F 1/00* (2006.01)

(52) U.S. Cl. ..... 273/292

(58) Field of Classification Search ..... 273/292; 463/13

See application file for complete search history.

(56) References Cited

U.S. PATENT DOCUMENTS

| | | | | |
|---|---|---|---|---|
| 4,443,012 | A * | 4/1984 | Makovic et al. | 273/292 |
| 7,410,417 | B2 * | 8/2008 | Feola | 463/13 |
| 2005/0093229 | A1 * | 5/2005 | Dewayne et al. | 273/146 |

* cited by examiner

*Primary Examiner* — Michael Dennis
(74) *Attorney, Agent, or Firm* — Altman & Martin; Steven K Martin

(57) ABSTRACT

A method of using a deck of playing cards that has a different number of cards than is needed for a game. If the number of cards needed is less than the number of cards in a deck, one deck is used. If the number of cards needed is greater than the number of cards in a deck, multiple decks are combined until the total number of cards exceeds the number needed. Then cards are removed from the combined deck, either randomly or predetermined, until the number of cards remaining is the same as the pool size.

2 Claims, 2 Drawing Sheets

METHOD OF USING DECKS OF PLAYING CARDS

CROSS-REFERENCES TO RELATED APPLICATIONS

The present application claims the benefit of and priority to U.S. Provisional Patent Application No. 61/323,299, filed on Apr. 12, 2010 for title METHOD OF USING MULTIPLE DECKS OF PLAYING CARDS in the name of John Feola, and is hereby incorporated by reference in its entirety.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to gaming, more particularly, to games where more than one deck of cards are necessary.

2. Description of the Related Art

Most state gaming agencies have different rules by which games can be offered to the public, more particularly, the size of the pool from which numbers must be drawn. For example, in Nebraska, in order to play games such as keno, numbers must be drawn from a pool of 80 numbers. This restriction eliminates many card games from use, particularly those that use a card deck with fewer cards than the required size of the pool.

BRIEF SUMMARY OF THE INVENTION

The present invention enables the use of a deck of playing cards that has a different number of cards than is needed for a game. Playing cards are removed to reduce the number of cards to the required number. If the required number is larger than the number of cards in a deck, multiple decks are combined.

The pool size is the number of members of a pool required by the game. For example, a numbers game that chooses from 80 numbers has a pool size of 80. If the pool size is less than the number of cards in a deck, one deck is used. If the pool size is greater than the number of cards in a deck, multiple decks are combined until the total number of cards exceeds the pool size.

Cards are removed from the combined deck until the number of cards remaining is the same as the pool size. The cards to remove can be chosen randomly or can be predetermined.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present invention enables the use of a deck of playing cards that is different in number than the number needed for a game. Playing cards are randomly or predeterminedly removed to reduce the number of cards to the required number for the game being played. If the required number is larger than the available deck of playing cards, multiple decks are combined.

Any game that requires a random draw from a pool of symbols or other tokens can incorporate the present invention. A non-exhaustive list includes bingo, keno, lotto, numbers games, and other games that use a pool size that is different from the number of cards in the deck being used. The games can be live, as a live bingo game with balls drawn from a cage, or virtual, as a statewide keno game.

Figure 1:
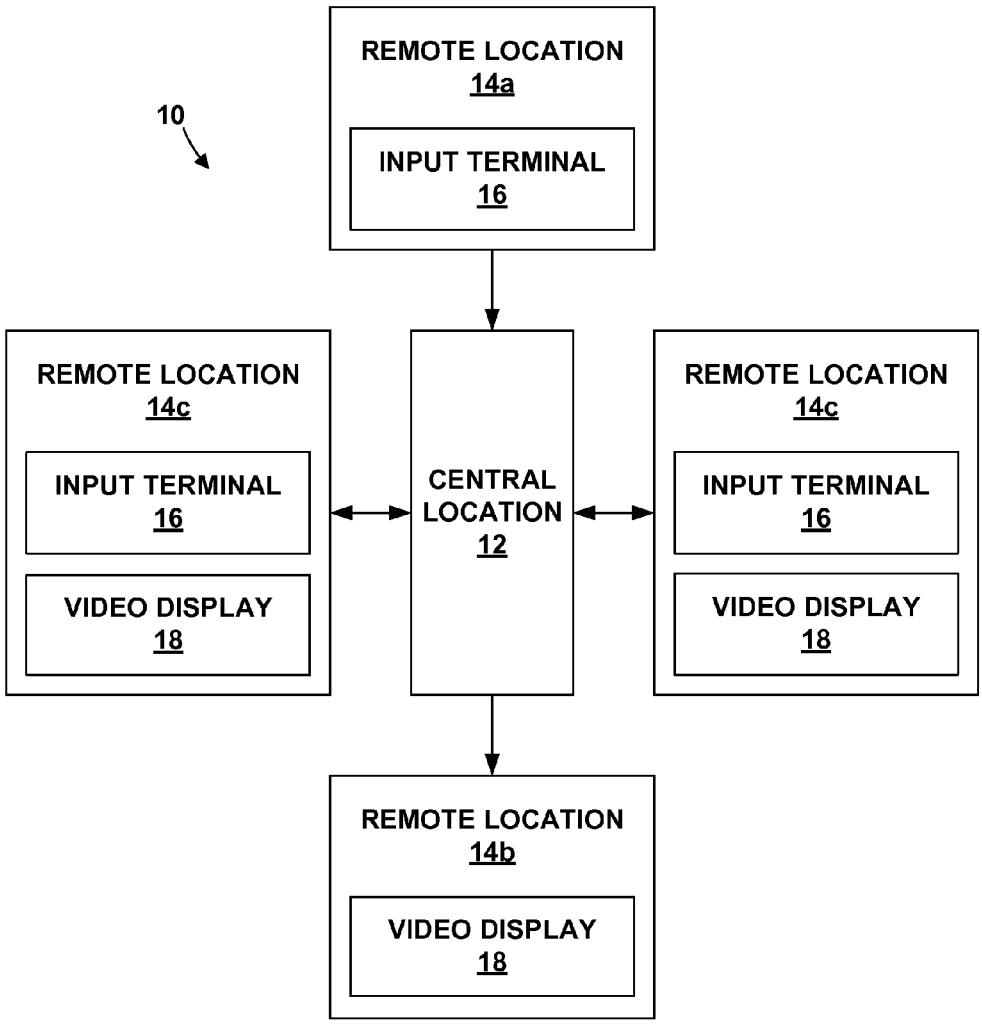
FIG. 1 is a block diagram of a typical keno system for which the present invention can be implemented.

Shown in FIG. 1 is a block diagram 10 of a keno system on which the present invention can be implemented. A central location 12 includes a processor that runs software programs. The central location 12 is operationally connected to a plurality of remote locations 14*a*, 14*b*, 14*c* (collectively, 14). The connection can be by the Internet or other global network. Alternatively, the connection can be by a private network, such as by dedicated wiring or wirelessly. Combinations of both can also be used.

Some remote locations 14*a* have an input terminal 16. Other remote locations 14*b* have a video display 18. Many of the remote locations 14*c* have both an input terminal 56 and a video display 18.

The input terminal 16 can take many different forms that are known in the art. In one example, the input terminal 56 is operated by a clerk to whom the player gives a marked paper slip with the player's choices. The clerk inputs those choices on the input terminal 16. In another example, the input terminal 16 is a terminal, such as a hand-held terminal, a floor terminal, or a kiosk, that permits a player to make choices directly using a keyboard, keys on a keypad, locations on a touch screen, etc. In yet another example, the player inputs choice via a personal computer on a network, mobile telephone, or PDA.

Keno games are played periodically. State-run keno games typically run continuously and a new game is played every few minutes. Winning numbers are drawn randomly electronically by the processor at the central location 12 and displayed on the video display 18.

A numbers system on which the present invention can be implemented is similar to the keno system of FIG. 1 with the exception that there are typically no remote video displays. Games are played periodically, but typically no more often than once or twice a day. Winning numbers are drawn randomly, either electronically or mechanically, and are posted where they can be found by the players, such as in a newspaper, on a Web site, etc.

The term "playing card" is used in the present specification to indicate a playing card, a symbol representing a playing card, or any facsimile thereof. For example, a playing card can be a paper playing card, a representation of a card on a table layout, an image of a card on a video display or monitor, an image of a card on a scratch ticket or bingo ball, etc. Any representation of a playing card is contemplated. A playing card as used in the present specification, can also be a ball, number, symbol, etc.—anything that can be randomly drawn.

In this specification, the term, "deck", refers to a group of playing cards. The number of playing cards in a deck is designated as N. For example, a standard poker deck consists of N=52 playing cards: 2-10, jack, queen, king, and ace in suits of hearts, spades, diamonds, and clubs. Optionally, one or two jokers are included. The remainder of the present specification uses a 52-card poker deck as an example, although any type of card deck with any number of playing cards is contemplated.

The term, "pool", is used in the present specification to refer to the set from which symbols must be drawn. The size of the pool, that is the number of symbols in the pool, is designated as P. The remainder of the present specification uses an example pool size of P=80, although any size pool that is larger or smaller than the number of cards in a deck is contemplated.

The term "token" is used in the present specification to indicate a member of the pool. For many games, a token is a number, for example, the numbers 1-35. For bingo, a token is a combination of a letter and a number.

Figure 2:
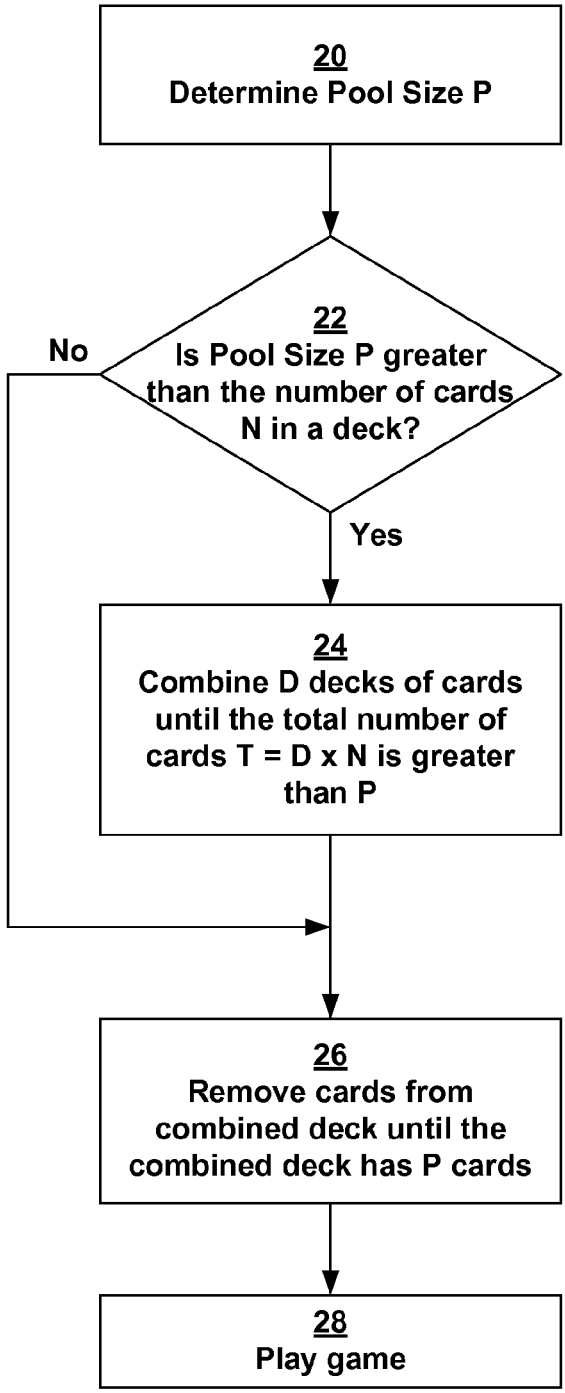
FIG. 2 is a flow diagram of the present invention.

A diagram of the present invention is shown in FIG. 2. After the pool size P is determined, as in 20, the number of decks D to combine is determined, as in 22. If the number of cards in a deck N exceeds the pool size P, only one deck is needed, and multiple decks are combined if the pool size P exceeds the number of cards in a deck N, as at 24. The number of decks, designated as D, that needs to be combined depends on the size of the pool P. The total number of cards of the combined decks is T=D×N and must equal or exceed the pool size P. For example, if the deck has 52 cards and the pool size is 35, only one deck is needed, and if the pool size is 80, two or more decks are combined. The term, "combined deck," is used to refer to a single deck, if the pool size is smaller than the number of cards in the deck, P<N, or the combination of decks if the pool size is larger than the number of cards in a deck, P>N.

Because the number of cards T in the combined deck will most likely be larger than the pool size P, some cards must be removed to reduce the combined deck to the pool size P, as at 26. The number of cards that must be removed is designated as R and is the number of cards in the combined deck T less the pool size P: R=T−P. In one illustrated example, the pool size P=35 and the combined deck size is T=52, so R=17 cards must be removed. In another illustrated example, the pool size P=80 and the combined deck size is T=104, so R=24 cards must be removed. Alternatively, cards can be removed from one of the decks before they are combined.

Removal of playing cards can be achieved in two different ways. Either randomly chosen or predetermined cards can be removed.

In order to remove cards randomly, the number of cards that are over the pool number are randomly chosen and removed before any cards are drawn for the game that is being played. The cards to be removed can be randomly drawn from the combined deck. Optionally, as each randomly drawn card is removed, any duplicates are also removed. Alternatively, the cards to be removed can be randomly drawn from one or more decks prior to the decks being combined. Optionally, any card removed from one deck is also removed from the other decks. The removed cards can be revealed to the player or not revealed to the player.

Alternatively, predetermined cards can be removed. In the illustrated example, the combined deck of 104 can be reduced to 80 by removing the eight 2's, eight 3's, and eight 4's, for a total of 24 cards. Remember that the combined deck has two of each card, hence eight cards of each value.

Both methods of removing randomly chosen cards and predetermined cards can be used together in the same game. For example, the eight 2's are removed and then 16 randomly chosen cards are removed.

The present invention contemplates that the cards can be removed prior to each game so that each game has different cards in the pool. Alternatively, the cards can be removed prior to a series of games so that each game of a series has the same cards in the pool.

After the combined deck is adjusted for the desired pool size, the game for which the pool is used is played, as at 28.

Since most or all of the cards of the combined deck are duplicated, it may be desirable to eliminate duplicates during game play. For example, if the goal of the game is to produce a standard poker hand, duplicates are undesirable. The present invention contemplates two different methods for removing duplicates during game play. In the first method, if a card is drawn that is a duplicate of a previously drawn card, the new card is discarded. In the second method, for every card that is drawn, all duplicates are immediately removed from the combined deck before the next card is drawn.

The following are two example of games that employ the method of the present invention.

The goal of the first game is to draw seven cards from a pool of 80 and make the best five-card poker hand, a form of seven-card stud. Two poker decks are combined into a combined deck of 104 cards. Prior to game play, 24 cards are randomly chosen and removed. Alternatively, 24 predetermined cards are removed.

The first card is drawn. The duplicate card—if it is still in the combined deck after removing the first 24 cards—is removed from the combined deck. Each of the next five cards is drawn in the same way, that is, any duplicate is removed after the card is drawn. The seventh card is drawn. There is no need to remove the duplicate, since no more cards will be drawn. At this point, seven different cards are drawn and the best five-card poker hand is made.

The second game is based on Texas Hold'em poker and is described in detail in U.S. Pat. No. 7,396,015, entitled Method of Playing a Poker-Type Game. In summary, there are five, known two-card starter hands: king of hearts and ace of diamonds, jack and queen of spades, 8 and 9 of diamonds, 5 of diamonds and 5 of hearts, and 2 of clubs and 7 of hearts. There are five hidden community cards that are part of all five hands. A player wagers on one or more of the five hands to be the winning hand. After wagering, the community cards are revealed and the winning hand is determined. The ten cards in the five starter hands do not change from game to game.

Two poker decks are combined into a combined deck of 104 cards. Prior to game play, first the 20 known starter hand cards—two each of the 2 and ace of clubs, the 5, 8, and 9 of diamonds, the 5, 7, and king of hearts, and the jack and queen of spades—are removed. Then four cards are randomly chosen and removed, for a total of 24 cards removed.

The first community card is drawn. The second community card is drawn. If it is a duplicate of the first community card, it is discarded and another card is drawn. The draws continue until there are five different community cards. At this point, the community cards are added to each of the starter hands and the best five-card poker hand is made from each hand.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A gaming system comprising:

(a) a plurality of remote input terminals;

(b) at least one display;

(c) a central location executing a game program, including receiving wagers and selections from said input terminals and generating an image on said at least one display;

(d) said game program including instructions for carrying out a method for using more than one poker deck of playing cards for a game that requires a pool size P larger than the number of playing cards N in each of said poker decks, said poker deck consisting of thirteen different playing cards in each of four suits with either zero, one, or two Jokers, said method comprising the steps of: (1) combining a number D of said poker decks such that the total of said playing cards $T=D\times N$ is greater than said pool size P; and (2) removing a number of playing cards R from said combined deck so that the number of playing cards in said combined deck is the same as said pool size P, $R=T-P$, said number of playing cards to remove R being a total of playing cards chosen randomly and all duplicates of said chosen cards.

2. The system of claim 1 wherein said poker deck of playing cards consists of 2, 3, 4, 5, 6, 7, 8, 9, 10, Jack, Queen, King, and Ace in each of suits Spades, Hearts, Clubs, and Diamond, with zero, one, or two Jokers for a total of either 52, 53, or 54 playing cards.

* * * * *